US007347788B2

(12) United States Patent
Smith, II

(10) Patent No.: US 7,347,788 B2
(45) Date of Patent: Mar. 25, 2008

(54) SYNTHETIC ICE SURFACE SYSTEMS AND METHODS THEREOF

(75) Inventor: George T. Smith, II, Ogdensburg, NY (US)

(73) Assignee: Crowson Enterprises LLC, Canton, NY (US)

( * ) Notice: Subject to any disclaimer, the term of this patent is extended or adjusted under 35 U.S.C. 154(b) by 0 days.

(21) Appl. No.: 11/081,288

(22) Filed: Mar. 16, 2005

(65) Prior Publication Data

US 2005/0245332 A1 Nov. 3, 2005

Related U.S. Application Data

(60) Provisional application No. 60/553,668, filed on Mar. 16, 2004.

(51) Int. Cl.
*A63C 19/10* (2006.01)

(52) U.S. Cl. ..... 472/90; 472/88; 62/235; 52/586.1

(58) Field of Classification Search ..... 472/88–92; 62/69, 70, 235; 404/17, 35, 40; 52/586.1, 52/586, 586.2

See application file for complete search history.

(56) References Cited

U.S. PATENT DOCUMENTS

| | | | | |
|---|---|---|---|---|
| 2,138,085 A | | 11/1938 | Birtles | |
| 3,599,385 A | * | 8/1971 | LaRue | 52/250 |
| 3,771,891 A | | 11/1973 | Nirenski et al. | |
| 4,169,688 A | * | 10/1979 | Toshio | 404/40 |
| 6,139,438 A | * | 10/2000 | Park et al. | 472/90 |
| 6,866,589 B1 | * | 3/2005 | Widrick et al. | 472/90 |

* cited by examiner

*Primary Examiner*—Kien T Nguyen
(74) *Attorney, Agent, or Firm*—Nixon Peabody LLP

(57) ABSTRACT

A synthetic ice surface system includes a plurality of sections of synthetic ice and a plurality of dowels. At least a portion of an outer periphery of each section of synthetic ice has one or more passages. Each of the dowels has a pair of opposing ends and one end of one or more of the dowels mates in one of the passages in one of the sections of synthetic ice. Another end of the one or more of the dowels mates in another one of the passages in another one of the sections of synthetic ice to secure the adjacent sections of synthetic ice together and form a substantially smooth ice surface. The sections of synthetic ice and the dowels are made of substantially the same material.

28 Claims, 4 Drawing Sheets

SYNTHETIC ICE SURFACE SYSTEMS AND METHODS THEREOF

This application claims the benefit of U.S. Provisional Patent Application Ser. No. 60/553,668 filed Mar. 16, 2004, which is hereby incorporated by reference in its entirety.

FIELD OF THE INVENTION

The present invention generally relates to ice surfaces and, more particularly, relates to synthetic ice surface systems and a methods thereof.

BACKGROUND OF THE INVENTION

Typically, a synthetic ice surface has a plurality of pieces of synthetic ice which are secured together. When the pieces are joined together, a skater should be able to smoothly skate from one piece of synthetic ice to another.

Unfortunately, prior techniques for securing these pieces of synthetic ice together have had problems. For example, with these prior techniques gaps are often formed or develop between the pieces of synthetic ice. Additionally, over time these pieces of synthetic ice often are not level with respect to each other so that one or more of pieces of synthetic ice are either higher or lower than adjacent pieces of synthetic ice. Either of these situations with these prior synthetic ice surfaces is undesirable because a skater can catch an edge of the runner and fall on these gaps or uneven surfaces and risk injury.

SUMMARY OF THE INVENTION

A synthetic ice surface system in accordance with embodiments of the present invention includes a plurality of sections of synthetic ice and a plurality of dowels. At least a portion of an outer periphery of each section of synthetic ice has one or more passages. Each of the dowels has a pair of opposing ends and one end of one or more of the dowels mates in one of the passages in one of the sections of synthetic ice. Another end of the one or more of the dowels mates in another one of the passages in another one of the sections of synthetic ice to secure the adjacent sections of synthetic ice together and form a substantially smooth ice surface. The sections of synthetic ice and the dowels are made of substantially the same material.

A method for making a synthetic ice surface system in accordance with embodiments of the present invention includes providing a plurality of sections of synthetic ice where at least a portion of an outer periphery of each section of synthetic ice has one or more passages. One end of one or more of a plurality of dowels mates in one of the passages in one of the sections of synthetic ice. Another end of the one or more of the dowels in another one of the passages mates in another one of the sections of synthetic ice to secure the adjacent sections of synthetic ice together and form a substantially smooth ice surface. The sections of synthetic ice and the dowels are made of substantially the same material.

A synthetic ice surface system in accordance with embodiments of the present invention includes a plurality of sections of synthetic ice, at least one cut-out region which extends across a break between adjacent sections of the synthetic ice, and at least one interlocking member. The interlocking member is shaped to mate with the cutout region and is made of substantially the same material as the sections of synthetic ice.

A method for making a synthetic ice surface system in accordance with embodiments of the present invention includes providing a plurality of sections of synthetic ice, forming at least one cut-out region which extends across a break between adjacent sections of the synthetic ice, and mating at least one interlocking member with the cutout region. The interlocking member is made of substantially the same material as the sections of synthetic ice.

The present invention provides a synthetic ice surface system which has and maintains a substantially smooth skating surface during use. Since the system expands and contracts as a single unit, gaps and uneven skating surfaces will not develop with the present invention. The synthetic ice surface system is also easy to assemble and is durable.

DETAILED DESCRIPTION

Figure 1:
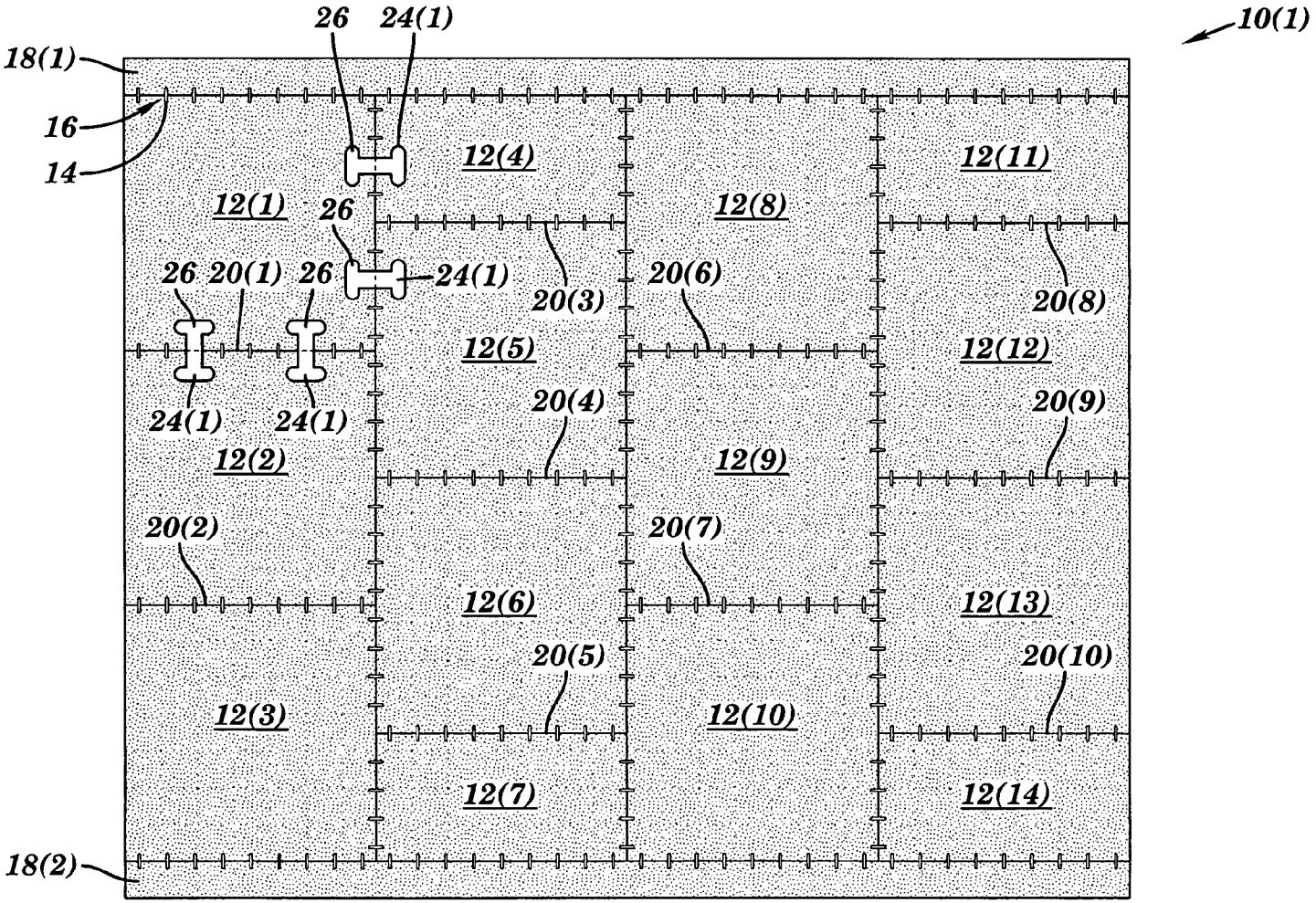
FIG. 1 is a cross-sectional top view of a synthetic ice surface system with a partial border in accordance with embodiments of the present invention.
Figure 7:
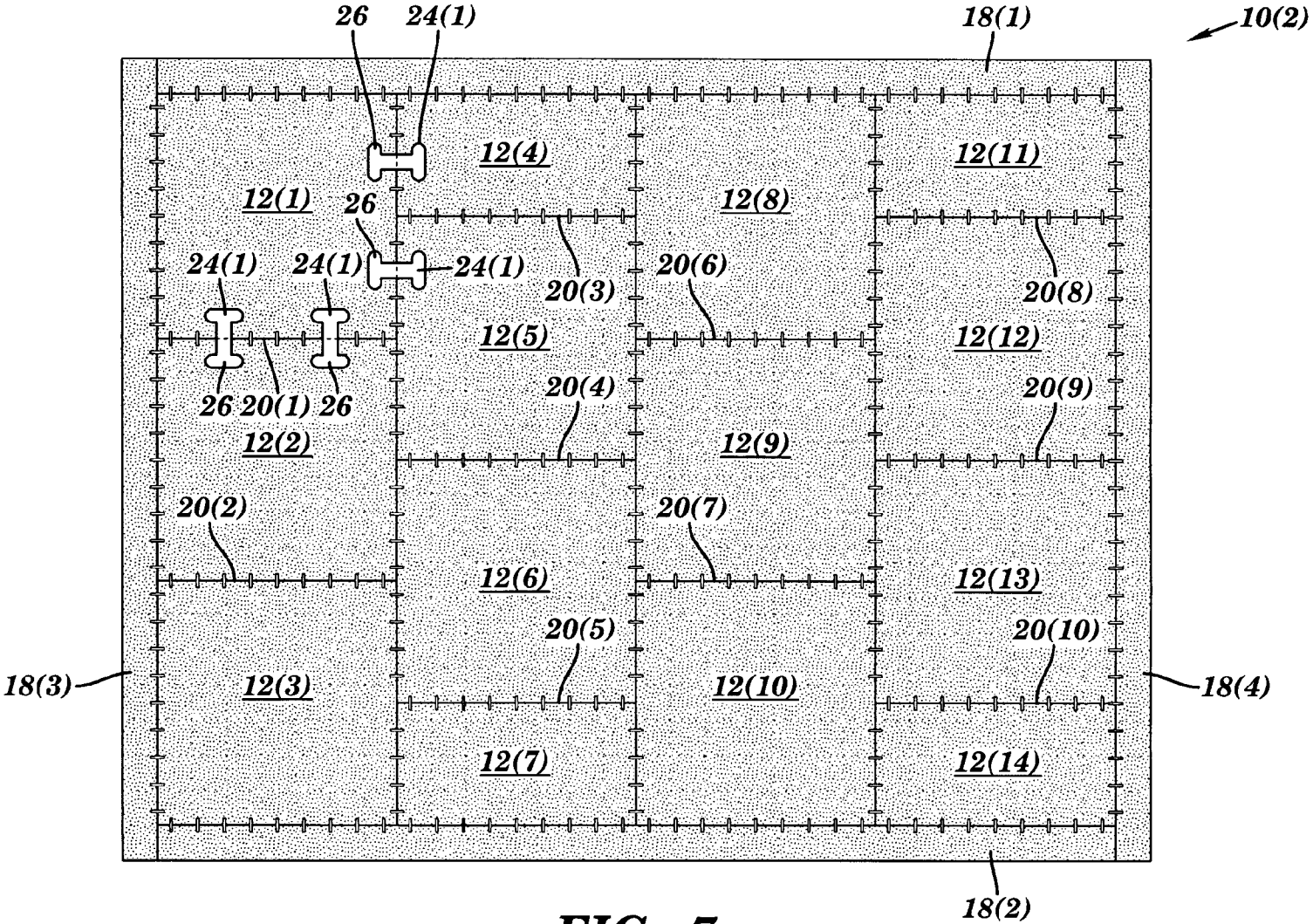
FIG. 7 is a cross-sectional top view of a diagram of a synthetic ice surface system with a substantially full border in accordance with embodiments of the present invention.

Synthetic ice surface systems 10(1) and 10(2) in accordance with embodiments of the present invention are illustrated in FIGS. 1 and 7. The synthetic ice surface systems 10(1) and 10(2) each include a plurality of sections of synthetic ice 12(1)-12(14), a plurality of dowels 14, a plurality of passages 16 and a border 18(1)-18(2), although the systems 10(1) and 10(2) each can comprise other numbers and types of components in other configurations. For ease of illustration, only one of the dowels 14 and one of the passages 16 are numbered in FIGS. 1 and 7, the other dowels 14 and passages 16 in FIGS. 1 and 7 are not numbered and are represented by the dashes between the plurality of sections of synthetic ice 12(1)-12(14) and between the plurality of sections of synthetic ice 12(1), 12(3), 12(4), 12(7), 12(8), 12(10), 12(11), and 12(14) and the border 18(1)-18(2) The present invention provides a synthetic ice surface system which has and maintains a substantially smooth skating surface during use.

Referring more specifically to FIGS. 1 and 7, the synthetic ice surface system 10(1) each comprises the plurality of sections of synthetic ice 12(1)-12(14), although the synthetic ice surface system 10(1) could comprise other numbers and types of sections of ice in other configurations. Each of the sections of synthetic ice 12(1)-12(3), 12(5), 12(6), 12(8)-12(10), 12(12), and 12(13) is about five feet wide by five feet long by one-half inch thick and has four sides and each of the sections of synthetic ice 12(3), 12(4), 12(7), 12(11), and 12(14) is about five feet wide by two and one-half feet long by one-half inch thick and also has four sides, although each of the plurality of sections of synthetic ice 12(1)-12(14) could have other dimensions in other shapes. Typically, the plurality of the sections of synthetic ice 12(1)-12(14) are made as large as possible to be able to handle with one person, although the again the dimensions and shape of each section can vary as necessary for the particular application. By way of example only, in applications where portability of the skating surface is not an issue, the plurality of sections of synthetic ice 12(1)-12(14) could be made much larger. The plurality of sections of synthetic ice 12(1)-12(14) may be labeled to assist an assembler in arranging the sections 12(1)-12(14) for connection.

The plurality of sections of synthetic ice 12(1)-12(14) are arranged in offset columns so that the breaks 20(1)-20(10) between the sections of synthetic ice 12(1)-12(14) are not aligned. More specifically, the breaks 20(1) and 20(2) in one column of sections of synthetic ice 12(1)-12(3) are not aligned with the breaks 20(3)-20(5) in the adjacent column of sections of synthetic ice 12(4)-12(7), the breaks 20(3)-20(5) in the column of sections of synthetic ice 12(4)-12(7) are not aligned with the breaks 20(6) and 20(7) in the adjacent column of sections of synthetic ice 12(8)-12(10), and the breaks 20(6) and 20(7) in the column of sections of synthetic ice 12(8)-12(10) are not aligned with the breaks 20(8)-20(10) in the adjacent column of sections of synthetic ice 12(11)-12(14), although the arrangement of the sections of synthetic ice 12(1)-12(14) can vary, such as having the sections of synthetic ice arranged in offset rows. With this offset arrangement, the synthetic ice surface systems 10(1) and 10(2) are more securely held together.

Figure 2:
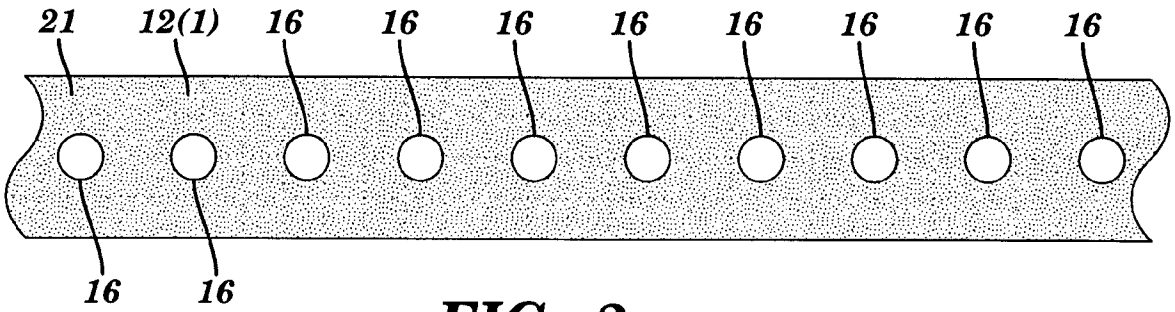
FIG. 2 is a side view of one of the sections of synthetic ice used in the synthetic ice surface system shown in FIG. 1.

Each of the sections of synthetic ice 12(1)-12(14) has a plurality of passages 16 which extend into the sides of each section 12(1)-12(14) as illustrated in FIGS. 1, 2, and 7. For ease of illustration only one side 21 of one of the sections of synthetic ice 12(1) with holes 16 is illustrated in FIG. 2, the other sides of the section of synthetic ice 12(1), the other sections of synthetic ice 12(2)-12(14) and the borders 18(1)-18(4) have the same shape and configuration for the passages 16, although the sides of one or more of the sections of synthetic ice 12(1)-12(14) and the borders 18(1)-18(4) could have other numbers and types of passages 16 in other configurations and locations.

The passages 16 have a circular cross-sectional shape with a diameter which is slightly larger than the diameter of one end 22(1) of the dowel 14 to form a snug fit when the one end 22(1) of the dowel 14 is mated with the passage 16 in the side of one of the sections of synthetic ice 12(1)-12(14) or the borders 18(1)-18(4), although the passages 16 could have other shapes and sizes which are designed to snugly mate with one end of the dowel 14. The passages 16 along each side of each the sections of synthetic ice 12(1)-12(14) and the borders 18(1)-18(4) are spaced six inches apart, except for the first passage 16 near the corner of each side of each of the sections of synthetic ice 12(1)-12(14) and the ends of the borders 18(1)-18(4) which are each three inches from the corner or end. Although one spacing and arrangement for the passages 16 is shown, other spacing and numbers of passages 16 and other mating arrangements can be used.

Figure 3:
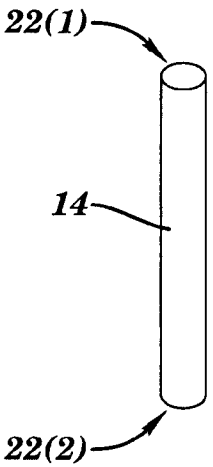
FIG. 3 is a side view of a dowel used in the synthetic ice surface system shown in FIG. 1.
Figure 4:
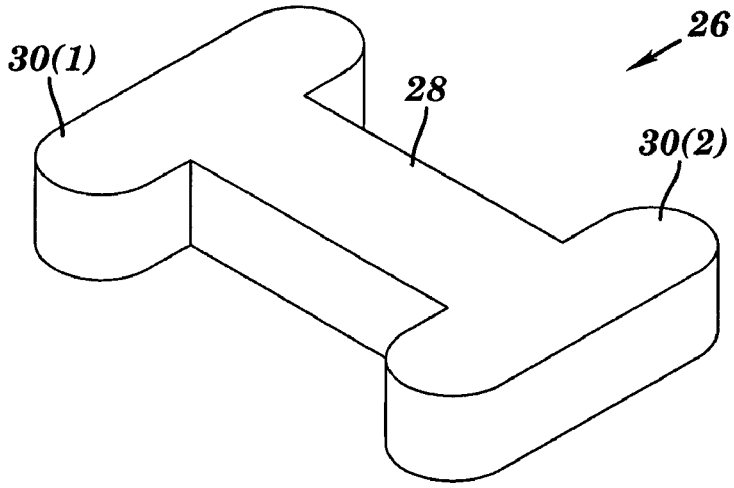
FIG. 4 is a perspective view of an interlocking member.

Referring to FIGS. 1, 3, and 7, each of the dowels 14 is elongated with an substantially circular cross-sectional shape, although each of the dowels 14 could have other shapes and configurations and other numbers of dowels could be used. Each of the dowels 14 also has a pair of opposing ends 22(1) and 22(2) which are each beveled slightly for ease of insertion into one of the passages 16, although one or more of the dowels 14 could have other shapes and sizes. The dowels 14 are made of substantially the same material as the plurality of sections of synthetic ice 12(1)-12(4). As a result, the dowels 14 and the plurality of sections of synthetic ice 12(1)-12(14) will thermally expand and contract at substantially the same rate, resulting in an ice surface that remains substantially smooth and without appreciable gaps at the breaks 20(1)-20(10) and also at the breaks between columns of the plurality of sections of synthetic ice 12(1)-12(14) so that a runner of a skate will not catch the break.

Referring back to FIG. 1, the border 18(1)-18(2) is formed along opposing sides of the ends of the columns of plurality of sections of synthetic ice 12(1), 12(3), 12(4), 12(8), 12(10), 12(11), and 12(14), although other types and arrangements for the border 18(1)-18(2) can be used, such as having the border 18(1)-18(4) extend substantially around the outer periphery of the joined plurality of sections of synthetic ice 12(1)-12(4), 12(7), 12(8), and 12(10)-12(14) as shown in FIG. 7. As discussed earlier, the inner periphery of the border 18(1)-18(4) has a plurality of passages 16 which are each designed to mate with one end of one of the dowels 14, although the number, type and configuration of the passages 16 can vary as needed for the particular application. The border 18(1)-18(4) is also made of substantially the same material as the plurality of sections of synthetic ice 12(1)-12(14) and the dowels. As a result, the borders 18(1)-18(14), dowels 14, and the plurality of sections of synthetic ice 18(1)-18(14) will thermally expand and contract at substantially the same rate, resulting in an ice surface that remains substantially smooth and without appreciable gaps at the breaks 20(1)-20(10) and also at the breaks between columns of the plurality of sections of synthetic ice 12(1)-12(14) so that a runner of a skate will not catch the break.

Figure 5:
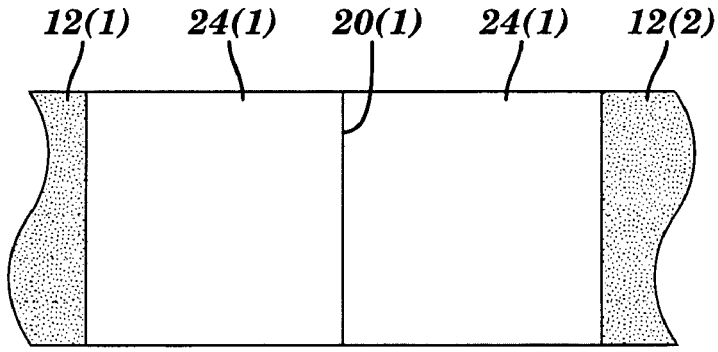
FIG. 5 is a cross-sectional side view of an embodiment of a cut out region in the synthetic ice surface.
Figure 6:
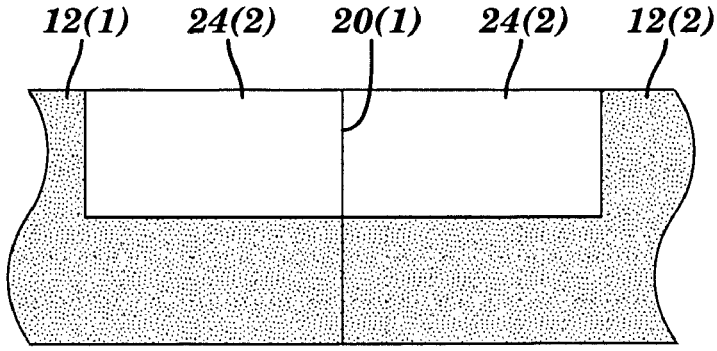
FIG. 6 is a cross- sectional side view of another embodiment of a cut out region in the synthetic ice surface.

Referring to FIGS. 1 and 4-7, a plurality of cut out regions 24(1) in the shape of a dog biscuit are formed between the adjacent sections of synthetic ice 12(1), 12(2), 12(4) and 12(5) across the break 20(1) and the break between the columns, although other shapes and numbers of cut out regions 24(1) in other locations could be used, such as between each of the plurality of sections of synthetic ice 12(1)-12(14) and between the plurality of sections of synthetic ice 12(1)-12(14) and the border 18(1)-18(4). The cut out regions 24(1) extend through the thickness of the sections of synthetic ice 12(1), 12(2), 12(4), and 12(5) as shown in FIG. 5, although the cut out regions 24(2) could be cut in other manners, such as partially extending through the sections of synthetic ice 12(1), 12(2), 12(4), and 12(5) as shown in FIG. 6. The cut out regions 24(1) and 24(2) can be formed on an opposing surface from the ice surface used for skating to minimize the number of breaks or grooves which could interfere with a runner of a skate. Additionally, the cutout regions 24(1) and 24(2) with the interlocking member 26 could be used in conjunction with and/or in place of the dowels 14 and the passages 16.

A matching interlocking member 26 in the shape of a dog biscuit mates with each of the cut out regions 24(1) or 24(2) to secure the adjacent sections of synthetic ice 12(1), 12(2), 12(4), and 12(5) together, although other shapes and types of interlocking members 26 can be used. Each of the interlocking members 26 has a central portion 28 located between enlarged portions 30(1) and 30(2) which helps to keep the adjacent sections of synthetic ice 12(1)-12(14) together, although the interlocking member 26 can have other shapes and configurations. The interlocking members 26 are also made of substantially the same material as the sections of synthetic ice 12(1)-12(14) and the dowels 14. As a result, the interlocking members 26, dowels 14, and sections of synthetic ice 12(1)-12(14) will again thermally expand and contract at substantially the same rate.

A method for making a synthetic ice surface 10(1) and 10(2) in accordance with embodiments of the present invention will be described with reference to FIGS. 1-7. The sections of synthetic ice 12(1)-12(14) are arranged adjacent to each other in the configuration in which they are to be secured together. Again, the sections of synthetic ice 12(1)-12(14) may be labeled to assist in laying out their configurations. The sections of synthetic ice 12(1)-12(14) are also arranged so that the breaks 20(1)-20(10) between adjacent columns of sections of synthetic ice 12(1)-12(14) are offset.

A plurality of dowels 14 are obtained and one end 22(1) or 22(2) of each dowel 14 is mated in one of the passages 16 in one of the sections of synthetic ice 12(1)-12(14)in FIGS. 1 and 7, in one of the pieces of the border 18(1)-18(2) in FIG. 1, or in the one of the pieces of the border 18(1)-18(4) in FIG. 7 and another end of each dowel 14 is mated in another one of the passages 16 in the adjacent one of the sections of synthetic ice 12(1)-12(14) in FIGS. 1 and 7, in one of the pieces of the border 18(1)-18(2) in FIG. 1, or in the one of the pieces of the border 18(1)-1 8(4) in FIG. 7 to secure the adjacent sections of synthetic ice 12(1)-12(14) in FIGS. 1 and 7 together or to secure one of the sections of synthetic ice 12(1)-12(14) to one of the pieces of the border 18(1)-18(2) in FIG. 1 or to one of the pieces of the border 18(1)-18(4) in FIG. 7 together to form part of the ice surface. The borders 18(1) and 18(2) in FIGS. 1 and 7 are secured along the ends of the columns because of the common break in the columns between adjacent sections of synthetic ice 12(1)-12(14). The border 18(3)-18(4) in FIG. 7 also helps to secure the sections of synthetic ice 12(1)-12(14) together.

If cut out regions 24(1) or 24(2) are formed between adjacent sections of synthetic ice 12(1)-12(14) in FIGS. 1 and 7 or between one of the sections of synthetic ice 12(1)-12(14) and one of the pieces of the border 12(1)-12(2) in FIG. 1 or one of the pieces of border 12(1)-12(4) in FIG. 7, then the interlocking member 16 is mated with each of the cut out regions 24(1) or 24(2) to secure the adjacent sections of synthetic ice 12(1)-12(14) in FIGS. 1 and 7 together or to secure one of the sections of synthetic ice 12(1)-12(14) to one of the pieces of the border 18(1)-18(2) in FIG. 1 or to one of the pieces of the border 18(1)-18(4) in FIG. 7 together to form part of the ice surface.

Accordingly, as illustrated and described above the present invention provides a synthetic ice surface system which has and maintains a substantially smooth skating surface during use. Additionally, the skating systems 10(1) and 10(2) are easy to assemble and are durable.

Having thus described the basic concept of the invention, it will be rather apparent to those skilled in the art that the foregoing detailed disclosure is intended to be presented by way of example only, and is not limiting. Various alterations, improvements, and modifications will occur and are intended to those skilled in the art, though not expressly stated herein. These alterations, improvements, and modifications are intended to be suggested hereby, and are within the spirit and scope of the invention. Additionally, the recited order of processing elements or sequences, or the use of numbers, letters, or other designations therefore, is not intended to limit the claimed processes to any order except as may be specified in the claims. Accordingly, the invention is limited only by the following claims and equivalents thereto.

What is claimed is:

1. A synthetic ice surface system comprising:

a plurality of sections of synthetic ice, at least a portion of an outer periphery of each section of synthetic ice has one or more passages;

at least one border having one or more passages and having a different shape from any of the plurality of sections of synthetic ice, the at least one border is secured along only one surface against at least a portion of the outer periphery of one or more of the plurality of sections of synthetic ice, the at least one border is made of substantially the same material as the plurality of sections of synthetic ice; and a plurality of dowels, each of the dowels has a pair of opposing ends and one end of one or more of the dowels mates in one of the passages in one of the sections of synthetic ice and another end of the one or more of the dowels mates in another one of the passages in another one of the sections of synthetic ice to secure the adjacent sections of synthetic ice together and form a substantially smooth ice surface and one end of one or more of the dowels mates in one of the passages in one of the sections of synthetic ice and another end of the one or more of the dowels mates in one of the passages in the at least one border to secure the sections of synthetic ice to the at least one border;

wherein the at least one border, the sections of synthetic ice and the dowels are made of substantially the same material and the plurality of sections of synthetic ice and the at least one border are freestanding to expand and contract as a single unit substantially without gaps and uneven skating regions on a skating surface formed by the plurality of sections of synthetic ice.

2. The system as set forth in claim 1 wherein the plurality of sections of synthetic ice are secured together in two or more series, wherein each of the series is in an offset configuration with an adjacent one of the series so that breaks between adjacent sections of the synthetic ice in each of the series are offset from the breaks between adjacent sections in the synthetic ice in the adjacent one or more of the series.

3. The system as set forth in claim 1 wherein an inner periphery of the border has one or more passages and wherein one end of one or more of the plurality of dowels mates in one of the passages in the border and another end of the one or more of the plurality of dowels mates in one of the passages in the portion of the outer periphery of one or more of the plurality of sections of synthetic ice which form opposing sides of the substantially smooth ice surface to secure the border to the sections of synthetic ice.

4. The system as set forth in claim 1 wherein at least one end of one or more of the plurality of dowels is beveled.

5. The system as set forth in claim 1 further comprising:

at least one cut-out region which extends across a break between adjacent sections of the synthetic ice; and at least one interlocking member which is shaped to mate with the cutout region, the interlocking member is made of substantially the same material as the sections of synthetic ice and the plurality of dowels.

6. The system as set forth in claim 5 wherein the at least one cut-out region extends substantially through each of the adjacent sections of the synthetic ice.

7. The system as set forth in claim 5 wherein the at least one cut-out region extends only partially through each of the adjacent sections of the synthetic ice.

8. The system as set forth in claim 5 wherein the at least one interlocking member comprises a central section between end sections, wherein the central section has a narrower width than the end sections.

9. A method for making a synthetic ice surface system, the method comprising:

providing a plurality of sections of synthetic ice, wherein at least a portion of an outer periphery of each section of synthetic ice has one or more passages;

providing at least one border having one or more passages and having a different shape from any of the plurality of sections of synthetic ice, the at least one border is secured along only one surface against at least a portion of the outer periphery of one or more of the plurality of sections of synthetic ice, the at least one border is made of substantially the same material as the plurality of sections of synthetic ice;

mating one end of one or more of a plurality of dowels in one of the passages in one of the sections of synthetic ice; and mating another end of the one or more of the dowels in another one of the passages in another one of the sections of synthetic ice to secure the adjacent sections of synthetic ice together;

mating another end of other ones of the one or more of the dowels in one of the passages in the at least one border to secure the adjacent sections of synthetic ice to the at least one border, wherein the at least one border, the sections of synthetic ice and the dowels are made of substantially the same material and the plurality of sections of synthetic ice are freestanding and the at least one border to expand and contract as a single unit substantially without gaps and uneven skating regions on a skating surface formed by the plurality of sections of synthetic ice.

10. The method as set forth in claim 9 further comprising securing the plurality of sections of synthetic ice together in two or more series, wherein each of the series is in an offset configuration with an adjacent one of the series so that breaks between adjacent sections of the synthetic ice in each of the series are offset from the breaks between adjacent sections in the synthetic ice in the adjacent one or more of the series.

11. The method as set forth in claim 9 further comprising:

mating one end of one or more of the plurality of dowels in one or more passages along an inner periphery of the border; and mating another end of the one or more of the plurality of dowels mates in one of the passages in the portion of the outer periphery of one or more of the plurality of sections of synthetic ice which form opposing sides of the substantially smooth ice surface to secure the border to the sections of synthetic ice.

12. The method as set forth in claim 9 wherein at least one end of one or more of the plurality of dowels is beveled.

13. The method as set forth in claim 9 further comprising:

forming at least one cut-out region which extends across a break between adjacent sections of the synthetic ice; and mating at least one interlocking member with the cutout region, the interlocking member is made of substantially the same material as the sections of synthetic ice and the plurality of dowels.

14. The method as set forth in claim 13 wherein the at least one cut-out region extends substantially through each of the adjacent sections of the synthetic ice.

15. The method as set forth in claim 13 wherein the at least one cut-out region extends only partially through each of the adjacent sections of the synthetic ice.

16. The method as set forth in claim 13 wherein the at least one interlocking member comprises a central section between end sections, wherein the central section has a narrower width than the end sections.

17. A synthetic ice surface system comprising:

a plurality of sections of synthetic ice;

at least one cut-out region which extends across a break between adjacent sections of the synthetic ice and along an outer surface of the adjacent sections of the synthetic ice; and at least one interlocking member which is shaped to mate with the cutout region and detachably lock the adjacent sections of the synthetic ice in place without any other fasteners, the interlocking member is made of substantially the same material as the sections of synthetic ice, wherein the plurality of sections of synthetic ice are freestanding to expand and contract as a single unit substantially without gaps and uneven skating regions on a skating surface formed by the plurality of sections of synthetic ice.

18. The system as set forth in claim 17 wherein the plurality of sections of synthetic ice are secured together in two or more series, wherein each of the series is in an offset configuration with an adjacent one of the series so that breaks between adjacent sections of the synthetic ice in each of the series are offset from the breaks between adjacent sections in the synthetic ice in the adjacent one or more of the series.

19. The system as set forth in claim 17 further comprising a border which is secured against a portion of the outer periphery of one or more of the plurality of sections of synthetic ice, wherein the border is made of substantially the same material as the plurality of sections of synthetic ice, wherein the border and the plurality of sections of synthetic ice expand and contract as a single unit.

20. The system as set forth in claim 17 wherein the at least one cut-out region extends substantially through each of the adjacent sections of the synthetic ice.

21. The system as set forth in claim 17 wherein the at least one cut-out region extends only partially through each of the adjacent sections of the synthetic ice.

22. The system as set forth in claim 17 wherein the at least one interlocking member comprises a central section between end sections, wherein the central section has a narrower width than the end sections.

23. A method for making a synthetic ice surface system, the method comprising:

providing a plurality of sections of synthetic ice;

forming at least one cut-out region which extends across a break between adjacent sections of the synthetic ice and along an outer surface of the adjacent sections of the synthetic ice; and mating at least one interlocking member with the cutout region to detachably lock the adjacent sections of the synthetic ice in place without any other fasteners, the interlocking member is made of substantially the same material as the sections of synthetic ice, wherein the plurality of sections of synthetic ice are freestanding to expand and contract as a single unit substantially without gaps and uneven skating regions on a skating surface formed by the plurality of sections of synthetic ice.

24. The method as set forth in claim 23 further comprising securing the plurality of sections of synthetic ice together in two or more series, wherein each of the series is in an offset configuration with an adjacent one of the series so that breaks between adjacent sections of the synthetic ice in each of the series are offset from the breaks between adjacent sections in the synthetic ice in the adjacent one or more of the series.

25. The method as set forth in claim 23 further comprising securing a border against a portion of the outer periphery of one or more of the plurality of sections of synthetic ice, wherein the border is made of substantially the same material as the plurality of sections of synthetic ice, wherein the border and the plurality of sections of synthetic ice expand and contract as a single unit.

26. The method as set forth in claim 23 wherein the at least one cut-out region extends substantially through each of the adjacent sections of the synthetic ice.

27. The method as set forth in claim 23 wherein the at least one cut-out region extends only partially through each of the adjacent sections of the synthetic ice.

28. The method as set forth in claim 23 wherein the at least one interlocking member comprises a central section between end sections, wherein the central section has a narrower width than the end sections.

* * * * *